US008311898B2

(12) United States Patent
Zhang

(10) Patent No.: US 8,311,898 B2
(45) Date of Patent: Nov. 13, 2012

(54) DYNAMIC TWO-WAY AUCTION METHOD AND SYSTEM

(76) Inventor: Xiaolin Zhang, Charlotte, NC (US)

( * ) Notice: Subject to any disclaimer, the term of this patent is extended or adjusted under 35 U.S.C. 154(b) by 217 days.

(21) Appl. No.: 12/856,379

(22) Filed: Aug. 13, 2010

(65) Prior Publication Data

US 2012/0041833 A1 Feb. 16, 2012

(51) Int. Cl.
*G06Q 30/00* (2012.01)

(52) U.S. Cl. ..... 705/26.44; 705/26.41; 705/26.3; 705/26.4; 707/706; 707/708; 707/713; 707/722

(58) Field of Classification Search ..... 705/26.1–27.2; 707/705–722
See application file for complete search history.

(56) References Cited

U.S. PATENT DOCUMENTS

2002/0049642 A1* 4/2002 Moderegger et al. ..... 705/26
2008/0288439 A1* 11/2008 Chandley et al. ..... 707/1
2010/0082472 A1* 4/2010 Cheung ..... 705/37

OTHER PUBLICATIONS

"Business-to-business online auctions: key issues for purchasing process improvement". Emiliani, M L . Supply Chain Management 5. 4 (2000): 176.*

* cited by examiner

*Primary Examiner* — William Allen
(74) *Attorney, Agent, or Firm* — Summa, Additon & Ashe, P.A.

(57) ABSTRACT

The present invention discloses a method for dynamic two-way auction, applicable for auctioning participating goods, comprising: (1) setting, by a server. The descriptive information, possible search conditions and the relations which associate each search condition with the descriptive information of all participating goods are set up and stored on the server side; (2) sending, by a buyer terminal and/or a seller terminal, a search request which includes a search condition to the server; (3) parsing, by the server, the search request to obtain the search condition, determining whether a definition of a relation which associates the search condition with the descriptive information has been recorded, and performing step (4) if the relation has not been recorded; (4) defining, by the server, a relation which associates the search condition with the descriptive information of some participating goods.

6 Claims, 3 Drawing Sheets

DYNAMIC TWO-WAY AUCTION METHOD AND SYSTEM

FIELD OF THE INVENTION

The present invention can be classified under the information technology application field, and particularly, as a method and system for dynamic two-way continuous auction.

BACKGROUND OF THE INVENTION

Over recent years, with the development of Internet related technology, electronic commerce gains rapid growth as a new business model. In the open network environment provided by Internet, browser/server applications enable buyers and sellers to perform various commercial transactions without meeting each other, realizing transactions such as online purchasing by consumers, online trading between merchants, online payments and various business activities, trading activities, financial activities and related integrated serving activities.

For electronic commerce, the development of a highly efficient and convenient trading system and trading method has attracted the attention of people in the industry.

The auction mechanism has been proven by contemporary math game theories and economics theories as a market mechanism with the highest efficiency. EBAY, the well-known American electronic commercial company, builds its whole commercial model on one-sided normal auction, while PRICELINE.COM, another well-known American electronic commercial company, builds its whole commercial model on one-sided reverse auction. Due to adoption of the auction mechanism, which is much more efficient than other market mechanisms, the two companies survive the Internet bubble and stand out from the crowd to become top electronic commercial companies.

One-sided normal auction refers to an auction where the seller takes no action with multiple buyers biding in an ascending price manner, and the seller sells to the buyer offering the highest bid within the pre-defined time frame as long as the highest bid exceeds a reserve price set by the seller. One-sided reverse auction refers to an auction manner where the buyer takes no action with multiple sellers biding in a descending price manner, and buyer buys from with the seller offering the lowest bid as long as the lowest bid is lower than the reserve price set by the buyer. While one-sided auctions have high efficiency, two-way auction or double auction is proven to be the most efficient market mechanism. The modern stock market is the best example of two-way auction. Multiple buyers simultaneously bid in an ascending price manner, and at the same time multiple sellers simultaneously offer in a descending price manner. Once a bid of a buyer equates or exceeds an offer of a seller, the buyer and the seller consummate a buy/sell transaction.

Besides higher efficiency, the two-way auction also has other advantages over the one-sided auction; there is no preset time frame. Current two-way auction, however, has a fundamental defect. It is only applicable for homogeneous single commodity. Each heterogeneous commodity needs an independent auction. No sellers or buyers can make use of information of relevant but not homogeneous commodities in their bidding to achieve the highest efficiency of the market. For example, supposing today is Monday, plane tickets for flights leaving tomorrow from Changsha to Beijing and plane tickets for flights leaving the day after tomorrow from Changsha to Beijing are auctioned in two independent auctions in current auction systems. For buyers of plane tickets who plan to leave within this week from Changsha to Beijing, there is no such exact auction for plane tickets of the week from Changsha to Beijing, so the client has to choose one auction from all auctions meeting his/her requirements manually to participate. The potential problem is that the operator has to view similar commodities satisfying his/her requirements one by one, the efficiency of the market is lowered. That is, there may be another auction among all the auctions satisfying the client's requirements that has a lower final trading price than the price the client bids, but the client does not have the chance to participate in the auction due to limited operation skill of the operator or due to time restrains. This results in other clients buying the plane ticket at a lower price. This defect is fundamental in that the final auction prices of all the independent auctions cannot be predetermined in the current auction mechanism and that current auction mechanism does not provide any way to resolve this defect.

SUMMARY OF THE INVENTION

The present invention solves a technical problem by providing a method and system for dynamic two-way bidding auction to implement dynamically adding definitions of relations that associate descriptive information of participating goods with a search condition.

To solve the above technical problem, the present invention provides a method for dynamic two-way auction, applicable for auctioning participating goods, comprising:

(1) setting, by a server. The descriptive information, possible search conditions and the relations which associate each search condition with the descriptive information of all participating goods are set up and stored on the server side.

(2) sending, by a buyer terminal and/or a seller terminal, a search request which includes a search condition to the server;

(3) parsing, by the server, the search request to obtain the search condition, determining whether a definition of a relation which associates the search condition with the descriptive information has been recorded, and performing step (4) if the relation has not been recorded;

(4) defining, by the server, a relation which associates the search condition with the descriptive information of some participating goods.

Further, the relation which associates the search condition with the descriptive information in steps (1) and (4) is defined by utilizing formal language and formal logic and the setting of descriptive information of participating goods in step (1) comprises a step of price standardization.

further comprising:

(5) Searching, by the server, for all participating goods which satisfy the search condition according to the relation which associates the search condition with the descriptive information, sorting the resultant goods according to bidding prices of buyers and offering prices of sellers, and informing the buyer terminal and/or the seller terminal of the resultant auction queue.

further comprising:

(6) sending, by the buyer terminal and the seller terminal, offers and bids based on the current auction queue; these bids and offers may include new prices or pricing instructions.

(7) trading, by the server, consummating a buy/sell transaction for the seller terminal and the buyer terminal according to the double auction trading rule after receiving the bidding/offering instructions based on the current auction queue.

Specifically, consummating by the server the transaction for the seller terminal and the buyer terminal according to the double auction trading rule in step (7) comprising: setting, by the server, a transaction rule, consummating a transaction between a seller terminal offering the lowest price and a buyer terminal bidding the highest price within the current auction queue, wherein the transaction rule comprises: at a given time spot, at least one bidding price among bidding prices sent by buyer terminals is higher than or equates at least one of offering prices from seller terminals; or consummating by the server the transaction for the seller terminal and the buyer terminal according to the double auction rule in step (7) comprises: consummating the transaction according to the market price order rule.

To solve the above technical problem, the present invention still provides a method for dynamic two-way auction, applicable for auctioning participating goods, comprising:

(1) setting, by a server. The descriptive information, possible search conditions and the relations which associate each search condition with the descriptive information of all participating goods are set up and stored on the server side.

(2) sending, by a buyer terminal and/or a seller terminal, a search request which includes a search condition to the server;

(3) parsing, by the server, the search request to obtain the search condition, determining whether a definition of a relation which associates the search condition with the descriptive information has been recorded, and performing step (4) if the relation has not been recorded;

(4) defining, by the server, a relation which associates the search condition with the descriptive information of some participating goods.

Further, the relation which associates the search condition with the descriptive information in steps (1) and (4) is defined by utilizing formal language and formal logic and the setting of descriptive information of participating goods in step (1) comprises a step of price standardization.

further comprising:

(5) Searching, by the server, for all participating goods which satisfy the search condition according to the relation which associates the search condition with the descriptive information, sorting the resultant goods according to bidding prices of buyers and offering prices of sellers, and informing the buyer terminal and/or the seller terminal of the resultant auction queue.

further comprising:

(6) sending, by the buyer terminal and the seller terminal, offers and bids based on the current auction queue; These bids and offers may include new prices or pricing instructions.

(7) trading, by the server, consummating a buy/sell transaction for the seller terminal and the buyer terminal according to the double auction trading rule after receiving the bidding/offering instructions based on the current auction queue.

Specifically, consummating by the server the transaction for the seller terminal and the buyer terminal according to the double auction trading rule in step (7) comprising: setting, by the server, a transaction rule, consummating a transaction between a seller terminal offering the lowest price and a buyer terminal bidding the highest price within the current auction queue, wherein the transaction rule comprises: at a given time spot, at least one bidding price among bidding prices sent by buyer terminals is higher than or equals to at least one of offering prices from seller terminals; or consummating by the server the transaction for the seller terminal and the buyer terminal according to the double auction rule in step (7) comprises: consummating the transaction according to the market price order rule.

To solve the above technical problem, the present invention also provides a system for dynamic two-way auction, comprising: a setting module, a search request inputting module, a search request receiving module and a relation defining module;

wherein the setting module is used to set up descriptive information of the participating goods, various search conditions, and relations which associate each search condition with the descriptive information;

the search request inputting module is used to input a search request sent by a buyer terminal and/or a seller terminal, wherein the search request includes a search condition and a definition of a relation which associates the search condition with the descriptive information of some participating goods;

the search request receiving module is used to receive the search request, parse the search request to obtain the search condition, and send a defining instruction to the relation defining module after determining that the definition of the relation which associates the search condition with the descriptive information has not been recorded;

the relation defining module is used to define the relation which associates the search condition with the descriptive information.

Further, the setting module is further adapted to utilize formal language and formal logic for defining the relation which associates each search condition with the descriptive information, and to perform price standardization.

Further, a search and display module, used to search for all participating goods which satisfy the search condition according to the relation which associates the search condition with the descriptive information, sort the resultant goods according to bidding prices of buyers and offering prices of sellers, and inform the buyer terminals and/or the seller terminals of the resultant auction queue.

Further, the system also comprising: a bid/offer instructions sending module and a bid/offer instructions receiving module;

where the bid/offer instructions sending module is adapted to send bid/offer instructions by buyer terminals and seller terminals, wherein the bid/offer instructions may comprise new pricing information;

the bid/offer instructions receiving module is adapted to receive the bid/offer instructions, and consummate transactions for all the seller terminals and all the buyer terminals according to the double auction trading rule.

Further, the bid/offer instructions receiving module is adapted to set a transaction rule, consummate a transaction for a seller terminal offering the lowest price and a buyer terminal offering the highest price for all participating goods that satisfy the search condition, in which the transaction condition comprises: at least one bidding price among bidding prices sent by the buyer terminals is higher than or equates at least one offering price among offering prices sent by the seller terminals; or the bid/offer instructions receiving module is further adapted to consummate a transaction for a seller terminal and a buyer terminal according to the market price order rule.

The present invention provides a brand-new method and system for dynamic two-way auction. The method of the present invention can dynamically receive search conditions inputted by seller terminals and buyer terminals, implement definition of a relation which associates commodity information with a search condition given by a buyer terminal, a seller terminal and/or a server, so that the system can better satisfy user's requirements and becomes more adaptable. The present invention reserves all advantages of existing double auction, and further overcomes the fundamental defect of existing double auction manners, that is, the present invention is applicable for auctioning any goods that are not homogeneous and that are not uniform. Furthermore, both the buyers and the sellers can achieve transactions at the best prices at any time spot, thus better serving both parties. The method and the system of the present invention can also save trading time and improve trading efficiency.

DETAILED DESCRIPTION OF THE INVENTION

The main idea of the present invention is as follows: presetting search conditions and the relations which associate each search condition with the descriptive information of all participating goods, sending a search request by a buyer terminal and/or a seller terminal, parsing the search request, determining whether a definition of a relation which associates the search condition with the descriptive information has been recorded, and if the relation has not been recorded, defining a relation which associates the search condition with the descriptive information of some participating goods by the server, or accepting a definition of a relation which associates the search condition with the descriptive information of some participating goods by a buyer terminal or a seller terminal, searching for all participating goods which satisfy the search condition according to the relation which associates the search condition with the descriptive information, sorting the resultant goods according to bidding prices of buyers and offering prices of sellers, sending pricing instructions by the buyer terminal and the seller terminal, consummating a buy/sell transaction for the seller terminal and the buyer terminal according to the double auction trading rule after receiving the bidding/offering instructions based on the current auction queue by the server.

It can be understood that there may be many seller terminals and buyer terminals in the present invention.

The present invention can achieve real time and dynamic reception of a relation which associates each search condition with auctioned commodity information defined by a buyer terminal, a seller terminal and/or a server, so that all auctions are generated dynamically based on bidding prices of buyer terminals and seller terminals and relations which associates commodity information with search conditions instead of being fixed statically in advance.

A detailed description of the technical scheme according to the present invention is provided hereinafter with reference to attached drawings and specific embodiments.

Figure 1:
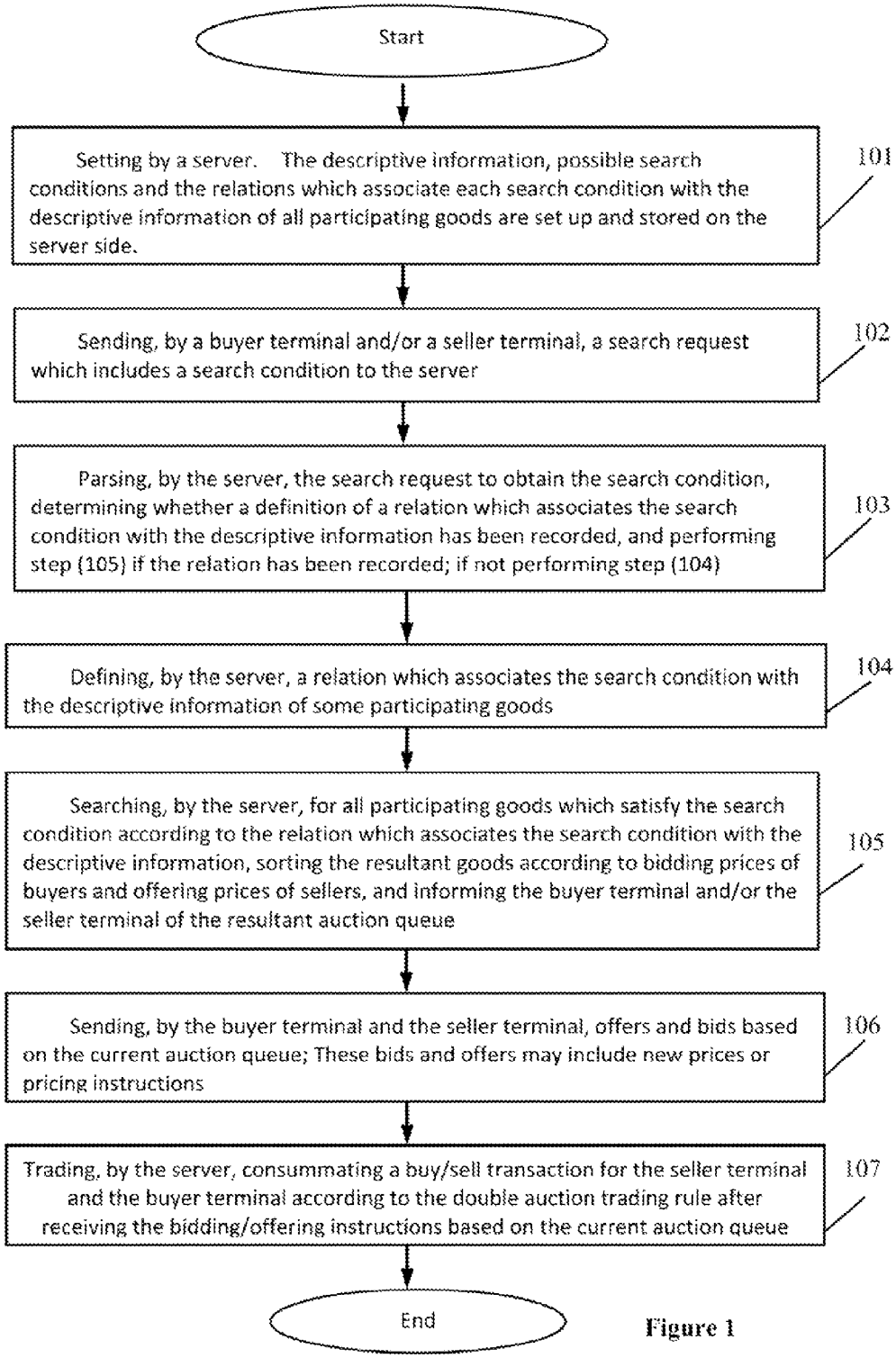
FIG. 1 is a flowchart illustrating the first actual example of the implementation of the method for dynamic two-way auction according to the present invention.

Referring to FIG. 1, the method of the present invention is based on a client-server framework. The method is applicable for auctioning commodities participated in the bidding, and includes the steps as follows.

In step 101, setting, by a server: The descriptive information, possible search conditions and the relations which associate each search condition with the descriptive information of all participating goods are set up and stored on the server side.

In step 102, sending, by a buyer terminal and/or a seller terminal, a search request which includes a search condition to the server;

In step 103, parsing, by the server, the search request to obtain the search condition, determining whether a definition of a relation which associates the search condition with the descriptive information has been recorded, and performing step (105) if the relation has been recorded; if not performing step (104);

In step 104, defining, by the server, a relation which associates the search condition with the descriptive information of some participating goods.

In step 105, searching, by the server, for all participating goods which satisfy the search condition according to the relation which associates the search condition with the descriptive information, sorting the resultant goods according to bidding prices of buyers and offering prices of sellers, and informing the buyer terminal and/or the seller terminal of the resultant auction queue.

Specifically, the informing step may include: displaying commodity information of commodities for auction on a public displaying screen, or displaying the information of the commodities for auction at the buyer terminal and/or at the seller terminal.

According to the preferred implementation of the present invention, the step of setting the descriptive information of the participating goods in step 101 includes a step of price standardization, i.e., setting the price of the goods to be a price that allows numeric comparison between bids and offers so that bidding prices by the buyer terminals and offering prices by the seller terminals for the goods can be compared with each other.

Further comprising:

In step 106, sending, by the buyer terminal and the seller terminal, offers and bids based on the current auction queue; these bids and offers may include new prices or pricing instructions.

In step 107, trading, by the server, consummating a buy/sell transaction for the seller terminal and the buyer terminal according to the double auction trading rule after receiving the bidding/offering instructions based on the current auction queue;

wherein consummating by the server the transaction for the seller terminal and the buyer terminal according to the double auction trading rule comprises: setting, by the server, a transaction rule, consummating a transaction between a seller terminal offering the lowest price and a buyer terminal bidding the highest price within the current auction queue, wherein the transaction rule comprises: at a given time spot, at least one bidding price among bidding prices sent by buyer terminals is higher than or equals to at least one of offering prices from seller terminals;

Or consummating by the server the transaction for the seller terminal and the buyer terminal according to the double auction rule comprises: consummating the transaction according to the market price order rule.

As an implementation of the present invention, the step of sorting all resultant goods according to bidding prices of the sellers and the buyers in step 105 includes: among buyer terminals offering the same bidding price, those buyer terminals with looser or weaker search conditions rank higher than those with stricter search conditions when sorted. Accordingly, buyer terminals ranking higher in the sorting have priority over others when transactions are conducted in step 107. Similarly, among those sellers with the same offering prices, the ones that can satisfy stronger search conditions rank higher than those that can satisfy weaker search conditions. Accordingly, seller terminals ranking higher in the sorting have priority over others when transactions are conducted in step 107.

It should be noted that, in this implementation, the relation which associates a search condition with descriptive information in step 101 and step 104 is defined utilizing a demand definition language, i.e., logical formal language and formal logic. The relation between the search condition and the commodity information may also be defined in other manners, which is not limited in the present invention. Any method which can implement dynamic defining relation which associates a search condition with commodity information can be used for achieving the objective of the present invention, and is within the protection scope of the present invention.

It can be seen from the above description that, the search conditions can be added dynamically by a buyer terminal or a seller terminal. After determining whether the buyer terminal or the seller terminal adds a search condition or not, the server defines a relation which associates the newly added search condition with the commodity information. In this way, the whole system is enabled to receive a search condition added by the buyer terminal or the seller terminal dynamically and in real time, and the server is enabled to define a relation for the newly added search condition and commodity information, so that the system can better satisfy the requirements of each user.

Figure 2:
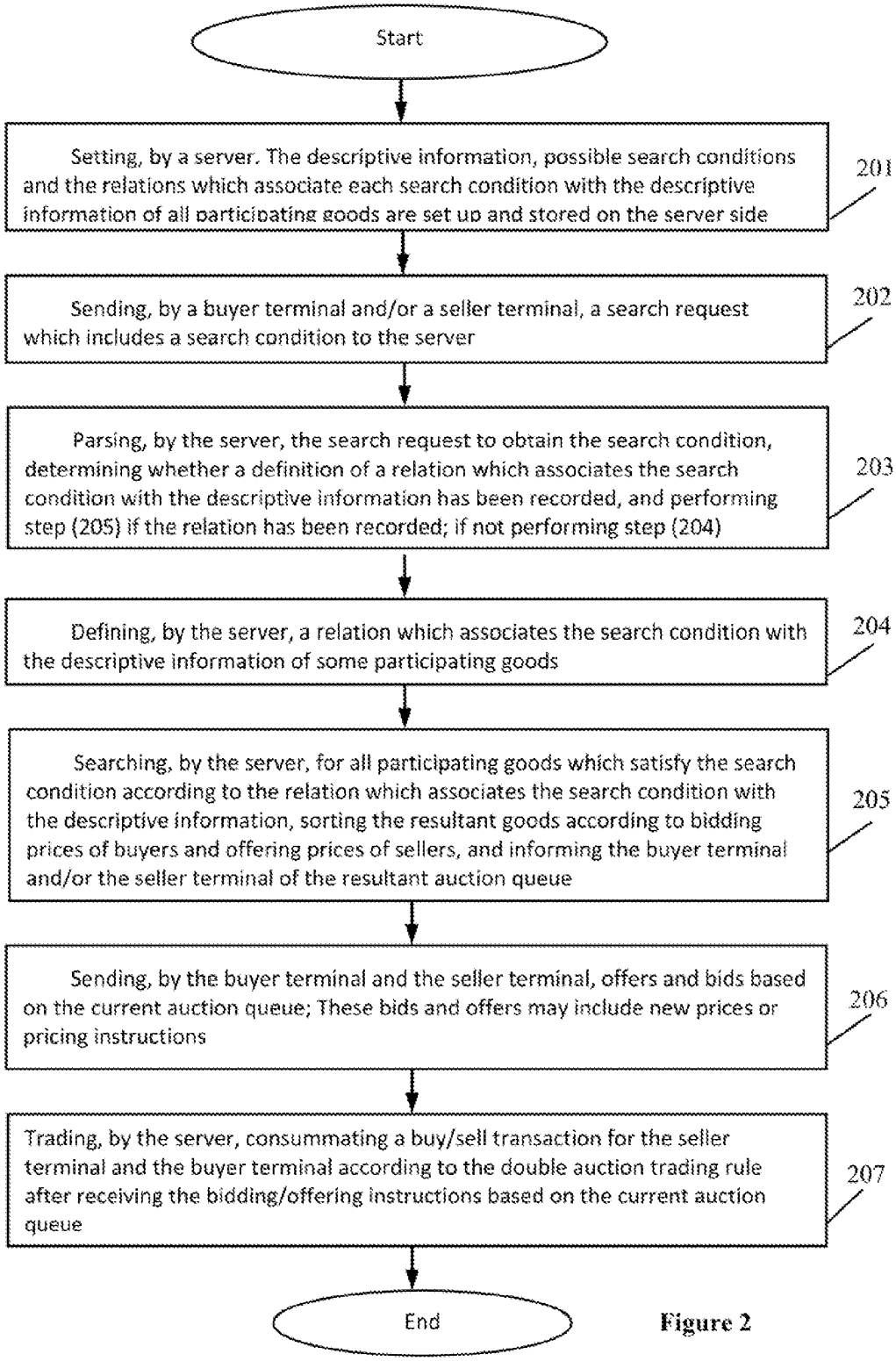
FIG. 2 is a flowchart illustrating the second actual example of the implementation of the method for dynamic two-way auction according to the present invention.

Referring to FIG. 2, in step 201, setting, by a server. The descriptive information, possible search conditions and the relations which associate each search condition with the descriptive information of all participating goods are set up and stored on the server side.

In step 202, sending, by a buyer terminal and/or a seller terminal, a search request which includes a search condition to the server;

In step 203, parsing, by the server, the search request to obtain the search condition, determining whether a definition of a relation which associates the search condition with the descriptive information has been recorded, and performing step (205) if the relation has been recorded, and performing step (204) if it has not been recorded.

In step 204, defining, by the server, a relation which associates the search condition with the descriptive information of some participating goods.

In step 205, searching, by the server, for all participating goods which satisfy the search condition according to the relation which associates the search condition with the descriptive information, sorting the resultant goods according to bidding prices of buyers and offering prices of sellers, and informing the buyer terminal and/or the seller terminal of the resultant auction queue.

According to the preferred implementation of the present invention, the step of setting descriptive information of participating goods in step 201 includes a step of price standardization, i.e., setting the price of the goods to be a price that allows numeric comparison between bids and offers so that bidding prices by the buyer terminals and offering prices by the seller terminals for the goods can be compared with each other.

Further comprising:

In step 206, sending, by the buyer terminal and the seller terminal, offers and bids based on the current auction queue; these bids and offers may include new prices or pricing instructions.

In step 207, trading, by the server, consummating a buy/sell transaction for the seller terminal and the buyer terminal according to the double auction trading rule after receiving the bidding/offering instructions based on the current auction queue.

Specifically, the informing in step 205 may include: displaying commodity information of commodities for auction on a public displaying screen.

Alternatively, the informing in step 205 may include: displaying the commodity information of the commodities for auction at the buyer terminal and/or at the seller terminal.

Consummating, by the server, the transaction for the seller terminal and the buyer terminal according to the double auction trading rule in step (207) comprises: setting, by the server, a transaction rule, consummating a transaction between a seller terminal offering the lowest price and a buyer terminal bidding the highest price within the current auction queue, wherein the transaction rule comprises: at a given time spot, at least one bidding price among bidding prices sent by buyer terminals is higher than or equates at least one of the offering prices from seller terminals;

Or consummating by the server the transaction for the seller terminal and the buyer terminal according to the double auction rule in step (207) comprises: consummating the transaction according to the market price order rule.

According to one implementation of the present invention, the step of sorting the resultant goods according to bidding prices of the sellers and the buyers in step 205 includes: among buyer terminals offering the same bidding price, those buyer terminals with looser or weaker search conditions rank higher than those with stricter search conditions when sorted. Accordingly, buyer terminals ranking higher in the sorting have priority over others when transactions are conducted in step 207. Similarly, among those sellers with the same offering prices, the ones that can satisfy stronger search conditions rank higher than those that can satisfy weaker search conditions. Accordingly, seller terminals ranking higher in the sorting have priority over others when transactions are conducted in step 207

It can be seen that, the differences between the present implementation and previous one lay in that, besides the search condition, the search request sent by the buyer terminal and/or the seller terminal to the server in step 202 further includes a definition of a relation which associates the search condition with the commodity information. Accordingly, the server directly records the definition of the relation between the search condition and the commodity information in step 204, so that the definition of the relation between the search condition and the commodity information by a buyer terminal or a seller terminal is achieved.

As can be seen, through the methods provided by the two implementations, the relation between the search condition and the commodity information can be defined by any one of the buyer terminal, the seller terminal and the server, thus the system becomes more adaptable.

Further, as yet another implementation of the present invention, a time period can be set in the step 207. After receiving price indications from buyer terminals within the time period set, the seller terminal selects a commodity with the lowest price among all commodities that can be chosen from, and conducts a transaction with a buyer terminal which offers the highest price among the price indications received.

Figure 3:
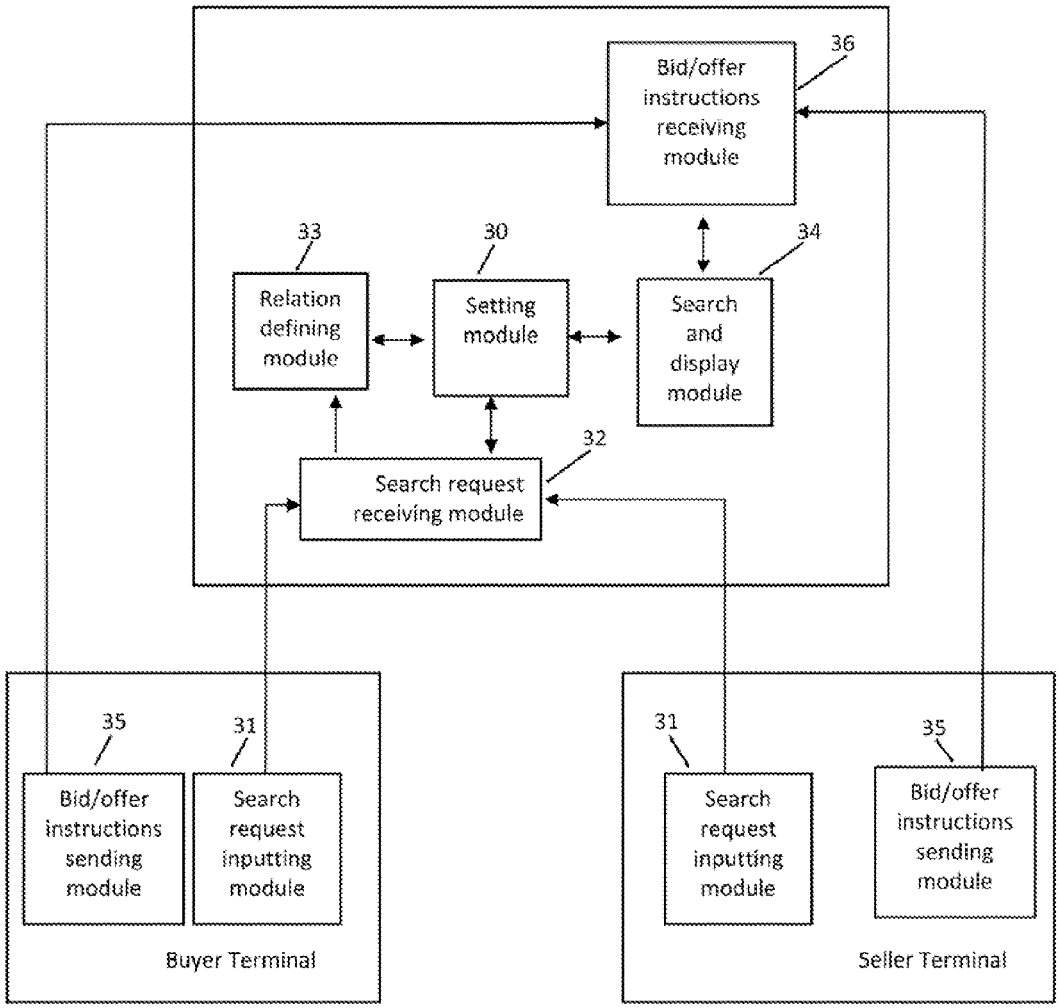
FIG. 3 is a block diagram illustrating the system for dynamic two-way auction according to the examples of the present invention.

As shown, FIG. 3 is a block diagram illustrating a system for dynamic two-way auction according to an implementation of the present invention. The system for dynamic two-way auction of the embodiment is based on client-server mode. The system includes: a setting module 30, a search request inputting module 31, a search request receiving module 32, a relation defining module 33; a search and display module 34, a bid/offer instructions sending module 35 and a bid/offer instructions receiving module 36.

The setting module 30 is used to set up descriptive information of the participating goods, various search conditions, and relations which associate each search condition with the descriptive information;

The search request inputting module 31 is used to input a search request sent by a buyer terminal and/or a seller terminal, wherein the search request includes a search condition and a definition of a relation which associates the search condition with the descriptive information of some participating goods;

The search request receiving module 32 is used to receive the search request, parse the search request to obtain the search condition, and send a defining instruction to the relation defining module 33 after determining that the definition of the relation which associates the search condition with the descriptive information has not been recorded;

The relation defining module 33 is used to define the relation which associates the search condition with the descriptive information.

The search and display module 34 is used to search for all participating goods which satisfy the search condition according to the relation, which associates the search condition with the descriptive information, sort the resultant goods according to bidding prices of buyers and offering prices of sellers, and inform the buyer terminals and/or the seller terminals of the resultant auction queue.

The bidding indication sending module 35 is adapted to send bid/offer instructions by buyer terminals and seller terminals, wherein the bid/offer instructions may comprise new pricing information;

The bidding indication receiving module 36 is adapted to receive the bid/offer instructions, and consummate transactions for all the seller terminals and all the buyer terminals according to the double auction trading rule.

Specifically, the setting module 30 is further adapted to define the relation which associates each search condition with the commodity information utilizing a formal language and formal logic. Preferably, the setting module 31 is further adapted to perform commodity price standardization.

In an embodiment of the present invention, the search and display module 34 is further adapted to put buyer terminals having looser search conditions ahead of buyer terminals which offer the same bidding price but have stricter search conditions when the commodity for auction satisfies multiple search conditions. Accordingly, the bidding indication receiving module 36 is adapted to choose by preference buyer terminals ranking higher for conducting the transaction.

The search and display module 34 is further adapted to display the commodity information of the commodity for auction and the bidding prices on a public displaying screen.

The search and display module 34 is further adapted to display the commodity information of the commodity for auction and the bidding prices on a buyer terminal and/or a seller terminal.

The bidding indication receiving module 36 is further adapted to set a transaction rule, and consummate a transaction for a seller terminal offering the lowest price and a buyer terminal offering the highest price for all participating goods that satisfy the search condition, The transaction condition comprises: at least one bidding price among bidding prices sent by the buyer terminals is higher than or equates at least one offering price among offering prices sent by the seller terminals;

The bidding indication receiving module 36 is further adapted to consummate a transaction for a seller terminal and a buyer terminal according to the market price order rule.

According to yet another implementation of the present invention, where the system for dynamic two-way auction is also based on the client-server mode, the system includes: a setting module, a search request inputting module, a search request receiving module, a relation defining module; a search and display module, a bid/offer instructions sending module and a bid/offer instructions receiving module, wherein the setting module is used to set up descriptive information of the participating goods, various search conditions, and relations which associate each search condition with the descriptive information.

The search request inputting module is used to input a search request sent by a buyer terminal and/or a seller terminal, wherein the search request includes a search condition and a definition of a relation which associates the search condition with the descriptive information of some participating goods;

the search request receiving module is used to receive the search request, parse the search request to obtain the search condition, and send a defining instruction to the relation defining module after determining that the definition of the relation which associates the search condition with the descriptive information has not been recorded;

the relation defining module is used to define the relation which associates the search condition with the descriptive information.

The search and display module, used to search for all participating goods which satisfy the search condition according to the relation which associates the search condition with the descriptive information, sorts the resultant goods according to bidding prices of buyers and offering prices of sellers, and informs the buyer terminals and/or the seller terminals of the resultant auction queue.

the bid/offer instructions sending module is adapted to send bid/offer instructions by buyer terminals and seller terminals, wherein the bid/offer instructions may comprise new pricing information;

the bid/offer instructions receiving module is adapted to receive the bid/offer instructions, and consummate transactions for all the seller terminals and all the buyer terminals according to the double auction trading rule.

The technical scheme of the present invention will be described hereinafter by referring to an example in practical application.

Example 1

Dynamic Two-Way Auction of Plane Tickets

In this example, the commodities to be traded are plane tickets, and the detailed process of buying a plane ticket according to the method for dynamic two-way auction of the present invention will be described as follows.

In step 1, information properties of each plane ticket is set, which can include: origination, destination, time of departure, time of arrival, airline, class, plane model and so on.

In step 2, various search conditions corresponding to the above information properties are set. For example, search conditions corresponding to the information property of "time of departure" may be: week, month, year, recent and so on; search conditions corresponding to the information property of "place of departure" may be: Beijing, Shanghai, Xi'an, etc. And buyers or sellers are allowed to add custom-defined search conditions for an information property.

In step 3, a relation that associates each search condition with an information item is set. For example, the information item of "recent" may be pre-set to be "within 10 days". The relation can also be added in real time by a buyer or a seller.

In step 4, prices are standardized, e.g., the plane ticket price can directly be use as the standardized price.

In step 5, a search request is received from a terminal, parsed to obtain a search condition in the search request, and then all tickets satisfying the search condition are found out according to the relations which associate search conditions with information items.

For example, the search condition in the search request may be "place of departure: Beijing; time of departure: recent". Supposing today is 11th day of the month, the commodities satisfying the search condition are plane tickets whose place of departure is Beijing and time of departure is from 11th to 21st day of the month according to the relations in step 3.

In step 6, bidding prices offered by buyers in the same auction and bidding prices offered by sellers in the same auction are sorted.

In step 7, a transaction is conducted according to the existing double auction rule, i.e., when a buyer offers a price higher than or equates the price offered by a seller, the buyer and the seller consummate a transaction.

Example Two

Dynamic Two-Way Auction of Complex Financial Instruments

In the previous example, the commodities to be traded are plane tickets, and the process of buying and selling a complex financial instrument according to the method for dynamic two-way auction of the present invention will be described in detail as follows.

In step 1, information properties of each complex financial product are set, which may include time limit, maturity date, amount, parameters of counter party, historical payment data, details of specified income, details of specified charges, etc.

In step 2, various search conditions corresponding to the above information properties are set. For example, a search condition corresponding to the information property of "maturity date" may be: week, month, year, recent, and so on. Buyers or sellers are allowed to add custom-defined search conditions for an information property.

In step 3, a relation that associates each search condition with an information item is set. For example, the information item of "recent" may be pre-set to be "within 10 days". The relation can also be modified in real time by a buyer or a seller.

In step 4, prices are standardized, e.g., a price can be standardized into a percentage of a par value. The par value is obtained by discounting net income of the complex financial product according to a certain interest rate.

In step 5, a search request is received from a terminal, parsed to obtain a search condition in the search request, and then all commodities satisfying the search condition are found out according to the relation that associates a search condition with an information property.

For example, the search condition in the search request is "maturity date: recent", supposing today is the 11th day of the month, then the complex financial products satisfying the search condition is complex financial products whose expiration data is from the 11th day to the 21st day of the month.

In step 6, bidding prices offered by all buyers in the same auction and bidding prices offered by all sellers in the same auction are sorted.

In step 7, a transaction is conducted according to the existing double auction rule, i.e., when a buyer offers a price higher than or equal to that offered by a seller, the buyer and the seller consummate a transaction.

From the above examples it can be seen that the method and system for dynamic two-way auction provided by the present invention are applicable to almost all commodities from all fields.

It should be noted that the foregoing description is only preferred implementation of the present invention and is meant to limit the protection scope thereof. All the equivalent replacements or improvements of technical features of the present invention shall be included in the protection scope of the present invention.

The invention claimed is:

1. A method for dynamic two-way auction, applicable for auctioning participating goods, comprising:

(1) setting, by a server, descriptive information, possible search conditions, and relations which associate each search condition with the descriptive information of all participating goods, wherein the setting of descriptive information of participating goods comprises a step of price standardization, wherein the descriptive information, possible search conditions, and relations which associate each search condition are set up and stored on the server;

(2) sending, by a buyer terminal and/or a seller terminal, a search request which includes a search condition to the server;

(3) parsing, by the server, the search request to obtain the search condition, determining whether a definition of a relation which associates the search condition with the descriptive information has been recorded, and performing step (4) responsive to a determination that the definition of a relation has not been recorded;

(4) defining, by the server, a relation which associates the search condition with the descriptive information of some participating goods, wherein the relation which associates the search condition with the descriptive information is defined by utilizing formal language and formal logic; and (5) searching, by the server, for all participating goods which satisfy the search condition according to the relation which associates the search condition with the descriptive information, sorting the participating goods which satisfy the search condition according to bidding prices of buyers and offering prices of sellers to create a resultant auction queue, and informing the buyer terminal and/or the seller terminal of the resultant auction queue.

2. The method of claim 1, further comprising:

(6) sending, by the buyer terminal and the seller terminal, offers and bids based on the resultant auction queue, wherein these bids and offers include new prices and/or pricing instructions; and (7) consummating, by the server, a buy/sell transaction for the seller terminal and the buyer terminal according to a double auction trading rule after receiving bidding/offering instructions based on the resultant auction queue.

3. The method of claim 2, wherein consummating, by the server, a buy/sell transaction in step (7) comprises:

(i)(a) setting, by the server, a transaction rule, and (b) consummating a transaction between a seller terminal offering the lowest price and a buyer terminal bidding the highest price within the resultant auction queue, wherein the transaction rule comprises: at a given time spot, at least one bidding price among bidding prices sent by buyer terminals being higher than or equates at least one of offering prices from seller terminals; or (ii) consummating the transaction according to a market price order rule.

4. A system for dynamic two-way auction, comprising:

computer-readable storage medium storing a setting module, a search request inputting module, a search request receiving module, a relation defining module, and a search and display module; and a processor configured to execute the modules stored in the computer-readable storage medium;

wherein the setting module is configured to set up descriptive information of participating goods, various search conditions, and relations which associate each search condition with the descriptive information, wherein the setting module is adapted to utilize formal language and formal logic for defining the relation which associates each search condition with the descriptive information, and to perform price standardization;

wherein the search request inputting module is configured to input a search request sent by a buyer terminal and/or a seller terminal, wherein the search request includes a search condition and a definition of a relation which associates the search condition with the descriptive information of some participating goods;

wherein the search request receiving module is configured to receive the search request, parse the search request to obtain the search condition, and send a defining instruction to the relation defining module after determining that the definition of the relation which associates the search condition with the descriptive information has not been recorded;

wherein the relation defining module is configured to define the relation which associates the search condition with the descriptive information; and wherein the search and display module is configured to (i) search for all participating goods that satisfy the search condition according to the relation, which associates the search condition with the descriptive information, (ii) sort the goods that satisfy the search condition according to bidding prices of buyers and offering prices of sellers to create a resultant auction queue, and (iii) inform buyer terminals and/or the seller terminals of the resultant auction queue.

5. The system of claim 4, further comprising: a bid/offer instructions sending module and a bid/offer instructions receiving module; wherein the bid/offer instructions sending module is adapted to send bid/offer instructions by buyer terminals and seller terminals, wherein the bid/offer instructions may comprise new pricing information; the bid/offer instructions receiving module is adapted to receive the bid/offer instructions, and consummate transactions for all the seller terminals and all the buyer terminals according to a double auction trading rule.

6. The system of claim 5, wherein the bid/offer instructions receiving module is further adapted:

(i) (a) to set a transaction rule and (b) to consummate a transaction for a seller terminal offering the lowest price and a buyer terminal offering the highest price for all participating goods that satisfy the search condition, wherein the transaction rule comprises: at least one bidding price among bidding prices sent by the buyer terminals being higher than or equates at least one offering price among offering prices sent by the seller terminals; or (ii) to consummate a transaction for a seller terminal and a buyer terminal according to a market price order rule.

* * * * *